US009863104B2

(12) United States Patent
Stukel et al.

(10) Patent No.: US 9,863,104 B2
(45) **Date of Patent: *Jan. 9, 2018**

(54) MODULAR GLARE SCREEN SYSTEM

(71) Applicant: American Louver Company, Skokie, IL (US)

(72) Inventors: William A. Stukel, Addison, IL (US); David S. Clark, Winfield, IL (US)

(73) Assignee: American Louver Company, Skokie, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/388,678

(22) Filed: Dec. 22, 2016

(65) Prior Publication Data

US 2017/0101749 A1 Apr. 13, 2017

Related U.S. Application Data

(63) Continuation of application No. 14/180,175, filed on Feb. 13, 2014, now Pat. No. 9,528,230.

(60) Provisional application No. 61/765,168, filed on Feb. 15, 2013.

(51) Int. Cl.
*E01F 7/06* (2006.01)

(52) U.S. Cl.
CPC ..... *E01F 7/06* (2013.01)

(58) Field of Classification Search
CPC ..... E01F 7/00; E01F 7/06; E01F 9/03; G09F 7/18; G09F 19/22
See application file for complete search history.

(56) References Cited

U.S. PATENT DOCUMENTS 4,338,041 A * 7/1982 Schmanski ..... E01F 7/06 256/13.1
4,504,168 A 3/1985 Miller
5,022,781 A * 6/1991 Smith ..... E01F 9/669 181/210
5,149,061 A * 9/1992 Borgnini ..... E01F 7/06 256/13.1

(Continued)

FOREIGN PATENT DOCUMENTS

FR 2698893 2/1995
FR 2632991 12/2010

(Continued)

OTHER PUBLICATIONS

International Search Report and Written Opinion dated Jun. 16, 2014 for related International Patent Application No. PCT/US2014/016412.

*Primary Examiner* — Abigail A Risic
(74) *Attorney, Agent, or Firm* — McDermott Will & Emery LLP

(57) ABSTRACT

A system includes a glare-blocking member including a left recess, a right recess, and a rail including, a left lateral portion including a left protrusion configured to mate with the left recess of the glare-blocking member, a right lateral portion including a right protrusion configured to mate with the right recess of the glare-blocking member, and a projecting contour disposed between the left and right lateral portions, wherein an apex of the projecting contour is disposed farther from a line passing through lower edge portions of the rail than is either the left or the right protrusion.

20 Claims, 6 Drawing Sheets

(56) References Cited

U.S. PATENT DOCUMENTS

| | | | | | |
|---|---|---|---|---|---|
| 5,190,394 | A * | 3/1993 | Mallon | E01F 9/669 | 404/6 |
| 5,224,791 | A * | 7/1993 | Syak | E01F 7/06 | 256/13.1 |
| 5,429,449 | A * | 7/1995 | Baatz | E01F 15/0453 | 256/13.1 |
| 5,641,241 | A * | 6/1997 | Rushing | E01F 9/669 | 256/13.1 |
| 6,149,338 | A * | 11/2000 | Anderson | E01F 8/0064 | 256/1 |
| 6,260,827 | B1 * | 7/2001 | Sicking | E01F 15/0407 | 256/13.1 |
| 6,835,023 | B1 * | 12/2004 | Paterson | E01F 15/083 | 116/63 R |
| 6,962,461 | B2 * | 11/2005 | Choi | E01F 7/06 | 256/13.1 |
| 7,850,317 | B2 | 12/2010 | Blackburn et al. | | |
| 8,230,628 | B2 * | 7/2012 | Recker | E01F 9/669 | 40/606.14 |
| 9,528,230 | B2 | 12/2016 | Stukel et al. | | |
| 2010/0118401 | A1 * | 5/2010 | Blackburn | E01F 9/669 | 359/552 |

FOREIGN PATENT DOCUMENTS

| | | |
|---|---|---|
| GB | 1025653 | 4/1966 |
| JP | 3914343 | 5/2007 |

* cited by examiner

MODULAR GLARE SCREEN SYSTEM

RELATED APPLICATIONS

This application is a continuation of U.S. patent application Ser. No. 14/180,175, filed Feb. 13, 2014, which claims priority to U.S. Provisional Application No. 61/765,168, filed Feb. 15, 2013, the contents of which are both hereby incorporated by reference in their entirety.

TECHNICAL FIELD

This application relates to a glare screen for a concrete barrier wall. In particular, this application relates to a modular glare screen for a barrier wall.

BACKGROUND

Concrete barriers are typically utilized to divide opposite flowing lanes of traffic. To prevent head light glare, glare screens may be attached to the top of the concrete barriers. The glare screens may utilize a number of blades connected to one or more rails.

Existing glare screens require complicated assembly of the blades to the rails. For example, brackets, nuts, rivets, bolts, pins, etc. may be required to secure the blades to the concrete barriers. Such requirements make it time consuming and relatively difficult to assemble and disassemble the glare screen.

Preassembly of the glare screens (or portions thereof) may be performed at a remote location. The preassembled glare screens may be transported to the work site for installation. However, assembled glare screens may be bulky and hard to handle, and may require more truck space and trips to the work site.

Glare screens may also be assembled in the field. While more product may be delivered per load when glare screens are transported unassembled, assemblers may be required to assemble the glare screen in potentially dangerous construction zones and in unpleasant outdoor conditions.

SUMMARY

In a first aspect, a glare-blocking system includes a glare-blocking member and a rail. The glare-blocking member includes a bottom edge, a left recess, and a right recess. The rail includes a left lateral portion that includes a left protrusion configured to mate with the left recess of the glare-blocking member. The rail also includes a right lateral portion that includes a right protrusion configured to mate with the right recess of the glare-blocking member. The rail includes a projecting contour between the left and right lateral portions that defines a groove configured to receive the bottom edge of the glare-blocking member.

In a second aspect, a glare-blocking member for a barricade includes a top edge and a bottom edge. Left and right edges of the glare-blocking member extend between the top edge and the bottom edge. A left recess is formed in the left edge proximate to the bottom edge. A right recess is formed in the right edge proximate to the bottom edge. The glare-blocking member is configured to be inserted into a rail that runs along a top of the barricade. The left and right recesses are configured to receive a pair of protrusions at either end of the rail when the glare-blocking member is inserted into the rail. The recesses cooperate with the protrusions to secure the glare-blocking member to the rail.

In yet another aspect, a rail for a barricade includes a first vertical edge portion on a left side of the rail that defines a first protrusion at an end of the first vertical edge portion that is configured to mate with a first recess of a glare-blocking member. The rail includes a second vertical edge portion on a right side of the rail that defines a second protrusion at an end of the second vertical edge portion that is configured to mate with a second recess of the glare-blocking member. The rail includes a projecting contour between the first and the second vertical edge portions that defines a groove configured to receive a bottom edge of the glare-blocking member.

Other aspects, features, and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION

The embodiments described below overcome the problems with existing glare screens by providing a rail with sections configured to deflect to allow for the quick insertion of a glare-blocking member into the rail.

Figure 1:
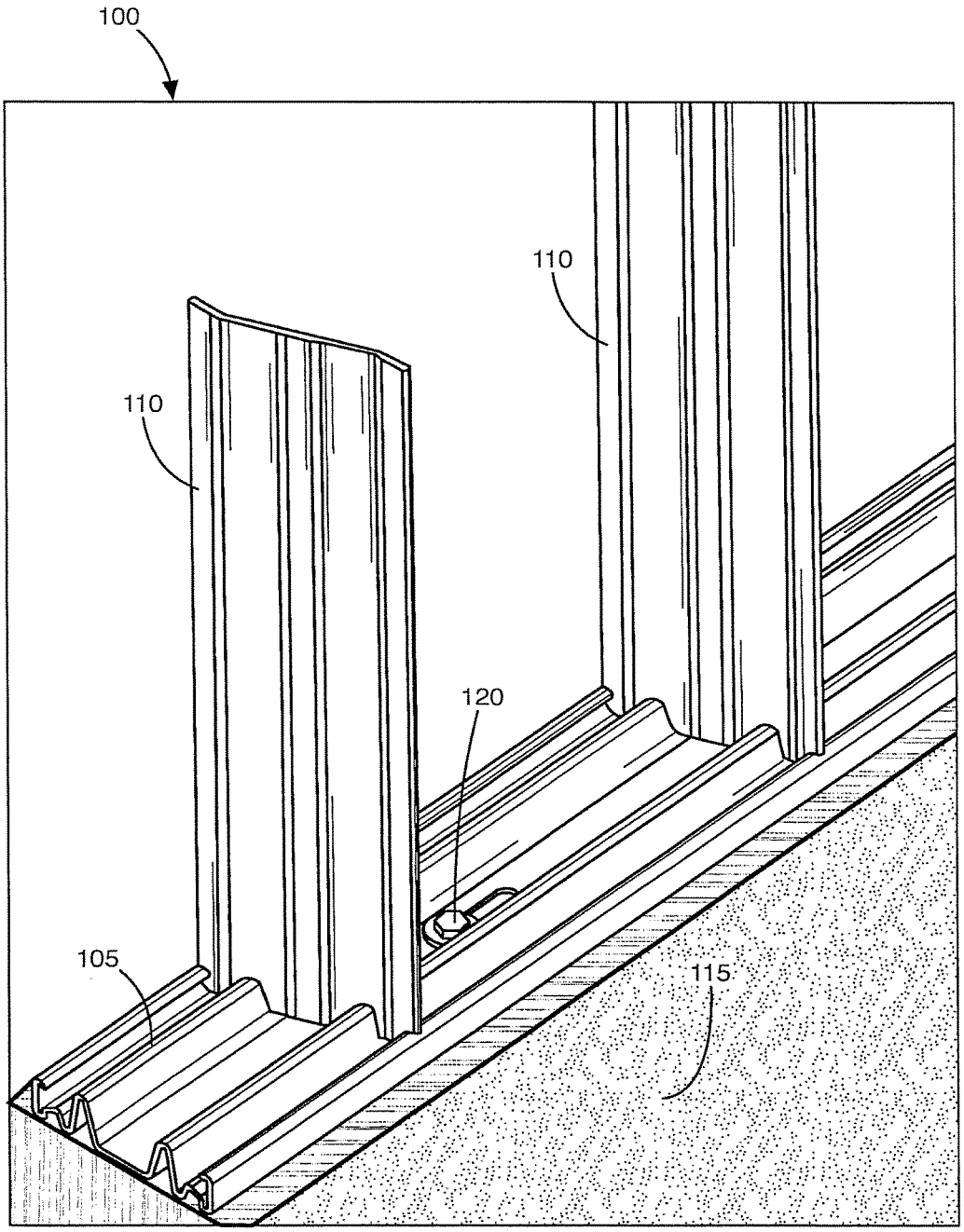
FIG. 1 illustrates an exemplary glare-blocking system.

FIG. 1 illustrates an exemplary glare-blocking system 100. Shown are glare-blocking members 110 and a rail 105. The rail 105 is fastened to a barricade 115, such as a concrete traffic barrier, via a fastener 120. The fastener 120 may be a self-tapping bolt or a different type of fastener. The rail 105 may have a length of about 12 feet or a different length. In an exemplary implementation, the glare-blocking members 110 are spaced along the rail 105 in a longitudinal direction at an interval of about 14½ inches. However, the spacing may be different.

Figure 2:
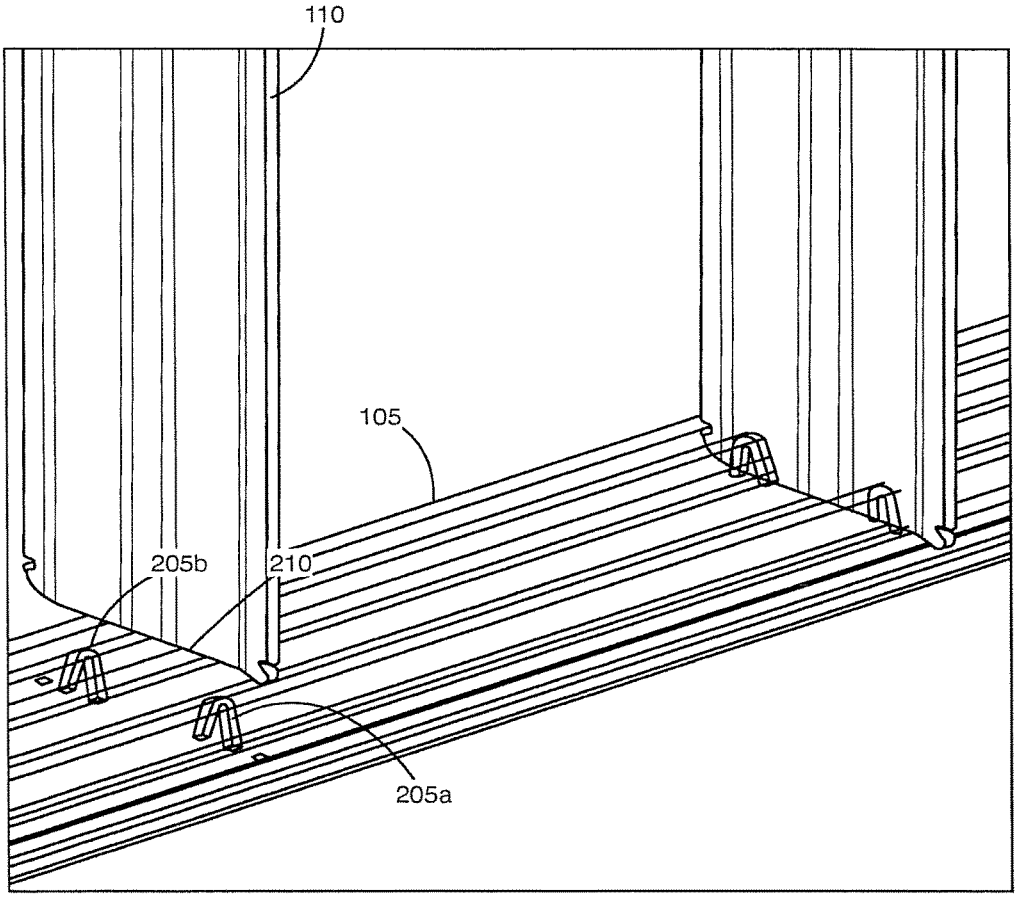
FIG. 2 illustrates grooves of the rail.

As illustrated in FIG. 2, the rail 105 includes a set of grooves/cutouts 205*ab* across the width of the rail 105 for receiving a lower edge 210 of a glare-blocking member 110. The gap width of each groove 205*ab* is sized to provide a snug fit with a glare-blocking member 110. For example, the width may be about 0.188 inches.

Figure 3A:
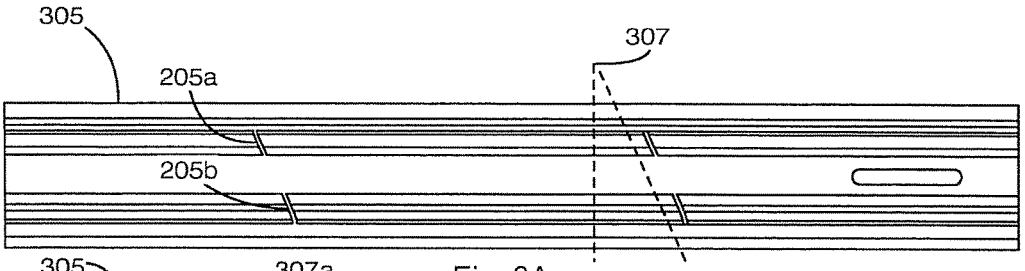
FIGS. 3A-3E illustrate top views of exemplary rail embodiments.
Figure 3B:
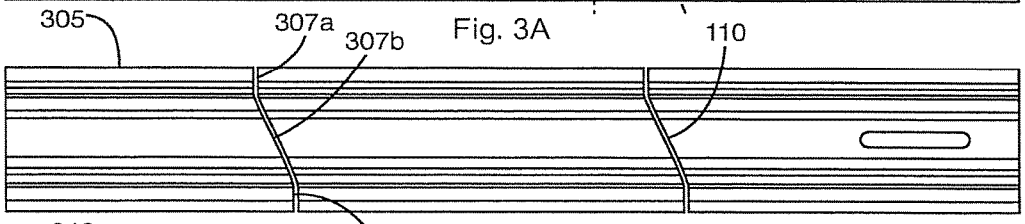

FIGS. 3A and 3B, illustrate, respectively, a top view of a first rail embodiment 305, and a top view of the first rail embodiment 305 with a glare-blocking member 110 inserted therein. In this embodiment, the grooves/cutouts 205*ab* are arranged to block headlight glare from oncoming traffic that is to the left of the driver. In one implementation, the grooves 205*ab* extend at an angle 307 of about 22 degrees with respect to a line that is perpendicular to a longitudinal axis of the rail 305.

Figure 3C:
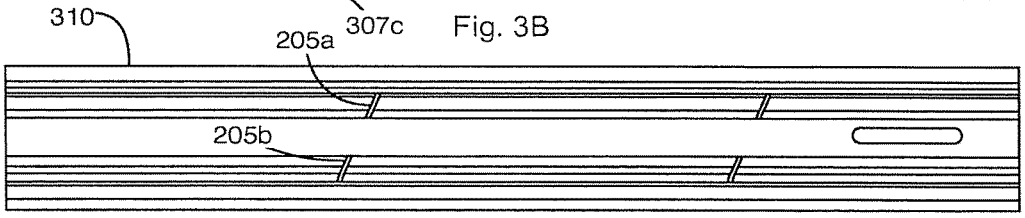
Figure 3D:
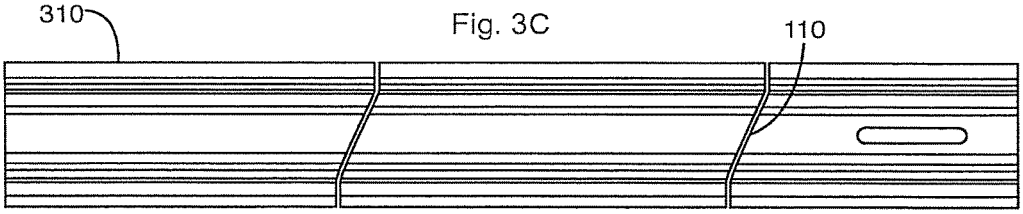

FIGS. 3C and 3D, illustrate, respectively, a top view of a second rail embodiment 310, and a top view of the second rail embodiment 310 with a glare-blocking member 110 inserted therein. In this embodiment, the grooves/cutouts 205*ab* are arranged to block headlight glare from oncoming traffic that is to the right of the driver.

Figure 3E:
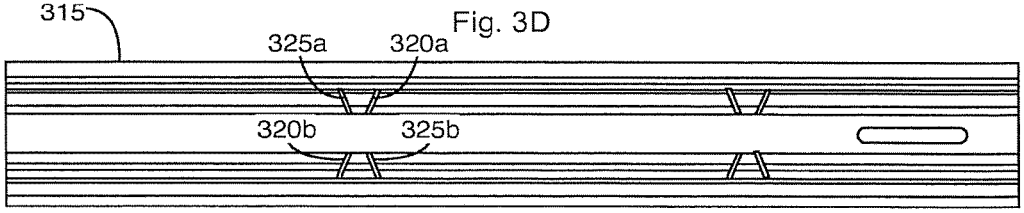

FIG. 3E, illustrates a top view of a third rail embodiment 315 that includes two sets of grooves/cutouts (320*ab* and 325*ab*) arranged to block headlight glare when the traffic flows in either situation described above. That is, the glare-blocking member 110 can be inserted into a first pair of grooves/cutouts 325*ab* to block headlight glare from oncoming traffic that is to the left of the driver, or into a second pair of grooves/cutouts 325*ab* to block headlight glare from oncoming traffic that is to the right of the driver. In this implementation, one set of grooves 320*ab* may extend at an angle 307 of about 22 degrees with respect to a line that is perpendicular to a longitudinal axis of the rail 305. The other set of grooves 325*ab* may extend at an angle 307 of about −22 degrees with respect to a line that is perpendicular to a longitudinal axis of the rail 305.

Figure 4:
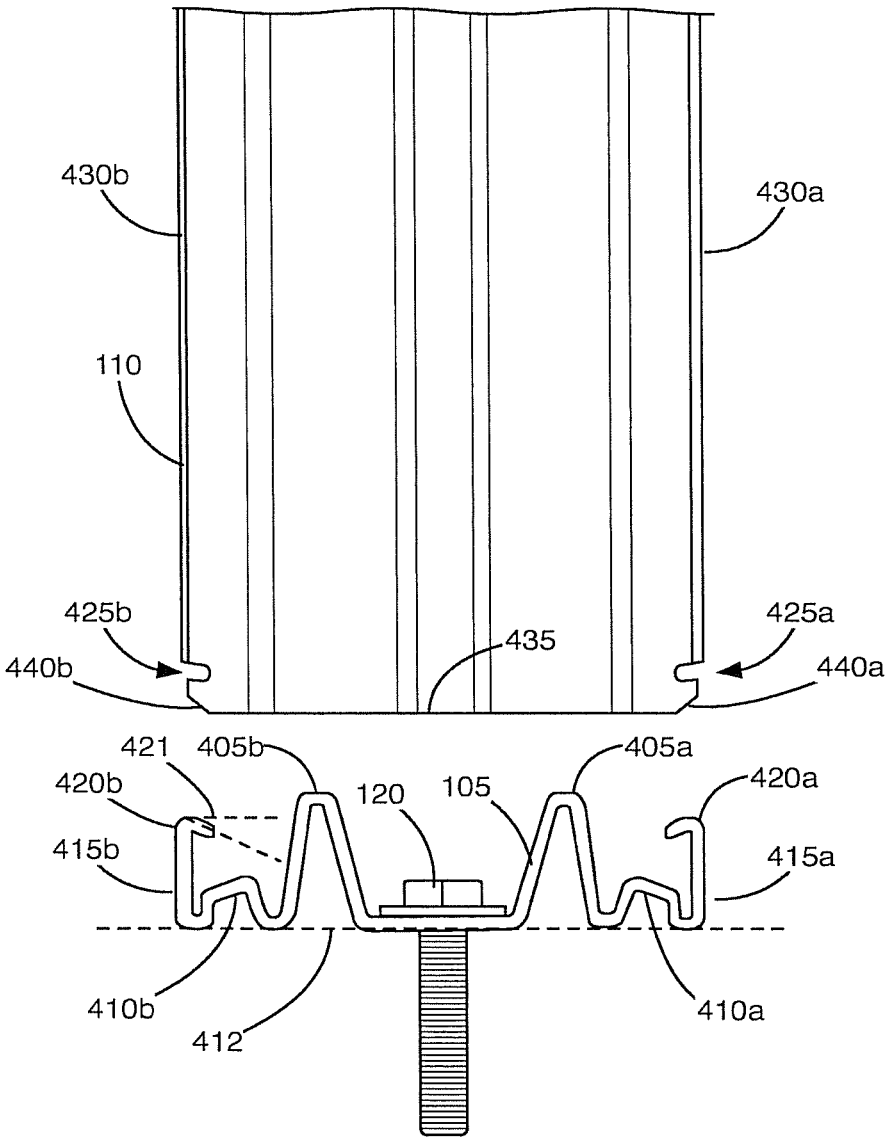
FIG. 4 illustrates a cross-section of a rail and a side view of a portion of a glare-blocking member.

FIG. 4 illustrates a cross-section of the rail 105 and a side view of a portion of glare-blocking member 110. The rail 105 includes a first set of left and right projecting contours 405*ab* that project in an upward direction toward the glare-blocking member 110 and a second set of left and right projecting contours 410*b* arranged adjacent to the first set of contours 405*ab*, respectively, that project in an upward direction toward the glare-blocking member 110. The rail 105 also includes left and right lateral side portions 415*ab* adjacent to the second set of contours 410*ab* that extend in a generally upright/vertical direction away from a line 412 that passes through lower edge portions of the rail 105, and left and right side protrusions 420*ab* that extend from respective ends of the left and right lateral portions 415*ab*. The left and right side protrusions 420*ab* slope in a downward direction towards the middle of the rail 105. In an exemplary implementation, the protrusions 420*ab* slope downward at an angle 421 of about 22 degrees. However, the downward angle may be different.

The grooves 205*ab* may be formed in the first set of left and right projecting contours 405*ab*. The grooves 205*ab* extend in a downward direction within the contours 410*ab* to a point that is below or at the apex of the second set of contours 410*b* when measured from the lower edge of the rail 105. The second set of contours 410*ab* function as a stop to limit the insertion depth of the glare-blocking member 110 within the grooves 205*ab*.

In some implementations, the rail member may not include the second set of contours 410*ab*. In this case, the groove depth of the first projecting contours 405*ab*, the location of the recesses 425*ab* in the glare-blocking member 110, and the location of the protrusions 420*ab* may be selected to provide a tight fit between the glare-blocking member 110 and the rail 105.

The glare-blocking member 110 is generally rectangular and includes first and second longitudinal edges 430*ab* and a lower edge 435. In an exemplary implementation, the glare-blocking member 110 may be about 24 inches high and six inches wide. However, the dimensions may be different. As can be seen from a top view (see FIG. 3B), the glare-blocking member may define first and second end sections 307*ac*, and a middle section 307*b* therebetween. The first and second end sections 307*ac* are configured to engage the rail 105 at angle of about 90 degrees with respect to the longitudinal axis of the rail 105. The first and second end sections 307*ac* may be offset from one another so that that middle section 307*b* forms an angle of about 22 degrees with respect to the longitudinal axis of the rail 105.

Returning to FIG. 4, first and second recesses 425*ab* are formed in the first and second longitudinal edges 430*ab*, respectively, near the lower edge 435 of the glare-blocking member 110. The lower edge 435 defines beveled corners 440*ab*. The angle of the beveled corners 440*ab* may be selected to complement the downward angle of the protrusions 420*ab*. In some implementations, the glare-blocking member 110 may include another pair of recesses (not shown) formed in the first and second longitudinal edges 430*ab*, respectively, proximate a top edge (not shown) of the glare-blocking member 110. The top edge may define beveled corners. The dual placement of these features facilitates reversing the orientation of the glare-blocking member 110 to facilitate insertion of the glare-blocking member 110 into the various rails illustrated in FIGS. 3A-3E.

Figure 5:
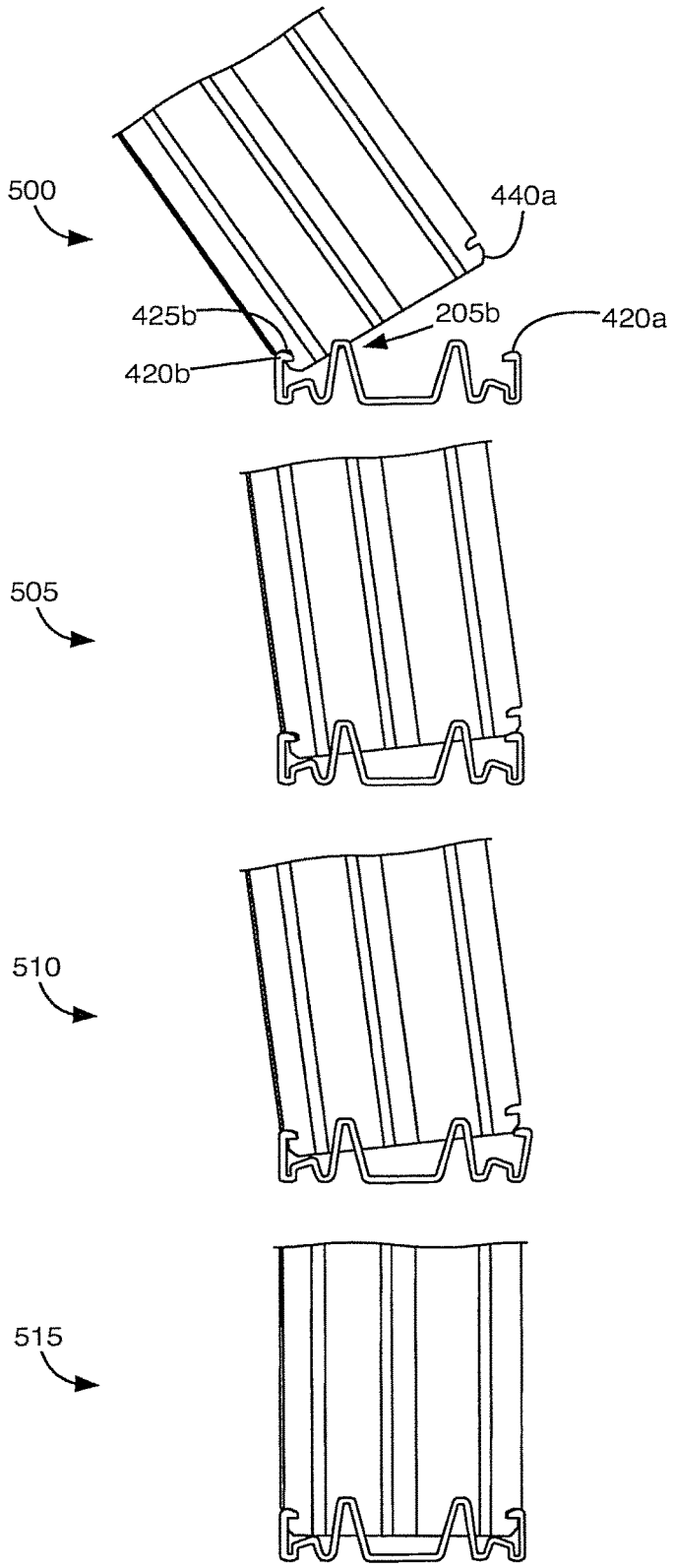
FIG. 5 illustrates exemplary operations for insertion of a glare-blocking member into a rail.

FIG. 5 illustrates exemplary operations for insertion of the glare-blocking member 110 into the rail 105. The rail 105 may be initially fastened to a barrier 115 via a bolt 120 or a different fastener. In a first operation 500, the glare-blocking member 110 is positioned so that the lower edge partially enters a first groove/cutout 205*b* and a recess 425*b* of a first edge of the glare-blocking member 110 is hooked into a first protrusion 420*b* of the rail 105. In a second operation 505, the glare-blocking member 110 is rotated about the hooked edge until the opposite edge contacts the second protrusion 420*a*. As illustrated in a third operation 510, continued application of rotational force on the glare-blocking member 110 causes the second protrusion 420*a* to deflect in an outward direction and the second protrusion 420*a* to ride over the beveled corners 440*a* of the glare-blocking member 110. As illustrated in fourth operation 515, the second protrusion 420*a* snaps into second recess 425*a*.

In an alternative implementation, the glare-blocking member 110 may be positioned over the grooved section of the rail 105 and then pushed down towards the rail 105 until the lower edge 435 of the glare-blocking member 110 enters both grooves 205*ab* and the beveled corners 440*ab* of the glare-blocking member 110 engage the protrusions 420*ab* of the rail 105. The force applied by continued downward pressure causes the protrusions 420*ab* to deflect in an outward direction and the protrusions 420 to ride over the beveled corners 440*ab* of the glare-blocking member 110 and to snap into the recesses 425*ab* of the glare-blocking member 110.

Figure 6:
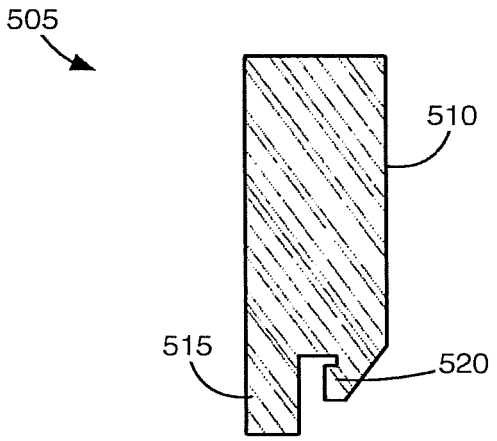
FIG. 6 illustrates an exemplary tool that facilitates removal of a glare-blocking member from a rail.

FIG. 6 illustrates an exemplary tool 500 that facilitates removal of a glare-blocking member 110 from a rail 105. The tool 500 includes a handle section 510, an extension section 515, and hook 520. In operation, that tool 500 is positioned adjacent to a glare-blocking member 110 to be removed. The tool 500 is rotated so that hook 520 engages a first protrusion 420*b* of the rail 105. After engagement, the tool 500 is rotated in an opposite direction until the extension section 515 reaches a lateral portion 415*ab* of the rail 105. Continued rotation causes the protrusion 420*b* to deflect out of the recess 425*b* of the glare-blocking member 110. Once the protrusion 420*b* is removed from the recess 425*b*, the glare-blocking member 110 may be rotated out of the rail 105 with little effort.

While various embodiments of the embodiments have been described, it will be apparent to those of ordinary skill in the art that many more embodiments and implementations are possible that are within the scope of the claims. For example, the various dimensions, angles, etc. described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

We claim:

1. A system, comprising:

a glare-blocking member including:

a left recess;

a right recess; and a rail including:

a left lateral portion including a left protrusion configured to mate with the left recess of the glare-blocking member;

a right lateral portion including a right protrusion configured to mate with the right recess of the glare-blocking member; and a projecting contour disposed between the left and right lateral portions, wherein an apex of the projecting contour is disposed farther from a line passing through lower edge portions of the rail than is either the left or the right protrusion.

2. The system of claim 1, wherein the projecting contour defines a groove configured to receive a bottom edge of the glare-blocking member.

3. The system of claim 1, wherein the rail includes a second projecting contour disposed between the first projecting contour and one of the left and right lateral portions.

4. The system of claim 3, wherein the second projecting contour defines a second groove configured to receive a bottom edge of the glare-blocking member.

5. The system of claim 3, wherein the rail further comprises:

a third projecting contour disposed between the first projecting contour and one of the left and right lateral portions; and a fourth projecting contour disposed between the second projecting contour and the other of the left and right lateral portions.

6. The system of claim 1 wherein the left lateral portion is disposed in a first position when the left protrusion of the rail engages the left recess of the glare-blocking member and the left lateral portion is disposed in the first position when the left protrusion of the rail is not engaged by any portion of the glare-blocking member and the left lateral portion is disposed in a second position when the left protrusion of the rail transitions from not engaging the left recess of the glare-blocking member to engaging the left recess of the glare-blocking member, and wherein the right lateral portion is disposed in a third position when the right protrusion of the rail engages the right recess of the glare-blocking member and the right lateral portion is disposed in the third position when the right protrusion of the rail is not engaged by any portion of the glare-blocking member and the right lateral portion is disposed in a fourth position when the right protrusion of the rail transitions from not engaging the right recess of the glare-blocking member to engaging the right recess of the glare-blocking member.

7. The system of claim 1, wherein lower corners of the glare-blocking member are beveled.

8. The system of claim 7, wherein an angle of the bevel is about 22 degrees.

9. A system, comprising:

a glare-blocking member including:

a left recess;

a right recess; and a rail including:

a left lateral portion including a left protrusion configured to mate with the left recess of the glare-blocking member;

a right lateral portion including a right protrusion configured to mate with the right recess of the glare-blocking member; and a projecting contour disposed between the left and right lateral portions, wherein an apex of the projecting contour is disposed closer to a line passing through lower edge portions of the rail than is either the left or the right protrusion.

10. The system of claim 9, wherein the apex of the projecting contour defines a lower stop for a bottom edge of the glare-blocking member.

11. The system of claim 9, wherein the rail includes a second projecting contour disposed between the first projecting contour and one of the left and right lateral portions.

12. The system of claim 11, wherein the apex of the second projecting contour defines a lower stop for a bottom edge of the glare-blocking member.

13. The system of claim 11, wherein the rail further comprises:

a third projecting contour disposed between the first projecting contour and one of the left and right lateral portions; and a fourth projecting contour disposed between the second projecting contour and the other of the left and right lateral portions.

14. The system of claim 9 wherein the left lateral portion is disposed in a first position when the left protrusion of the rail engages the left recess of the glare-blocking member and the left lateral portion is disposed in the first position when the left protrusion of the rail is not engaged by any portion of the glare-blocking member and the left lateral portion is disposed in a second position when the left protrusion of the rail transitions from not engaging the left recess of the glare-blocking member to engaging the left recess of the glare-blocking member, and wherein the right lateral portion is disposed in a third position when the right protrusion of the rail engages the right recess of the glare-blocking member and the right lateral portion is disposed in the third position when the right protrusion of the rail is not engaged by any portion of the glare-blocking member and the right lateral portion is disposed in a fourth position when the right protrusion of the rail transitions from not engaging the right recess of the glare-blocking member to engaging the right recess of the glare-blocking member.

15. The system of claim 9, wherein lower corners of the glare-blocking member are beveled.

16. The system of claim 15, wherein an angle of the bevel is approximately 22 degrees.

17. A system, comprising:

a glare-blocking member including:

a bottom edge;

a left recess;

a right recess; and a rail including:

a left lateral portion including a left protrusion configured to mate with the left recess of the glare-blocking member;

a right lateral portion including a right protrusion configured to mate with the right recess of the glare-blocking member;

a first projecting contour disposed between the left and right lateral portions; and a second projecting contour disposed between the left and right lateral portions, wherein a distance between the first projecting contour and one of the left and right lateral portions is the same as a distance between the second projecting contour and the other of the left and right lateral portions.

18. The system of claim 17, wherein the first projecting contour defines a groove configured to receive the bottom edge of the glare-blocking member.

19. The system of claim 17, wherein the second projecting contour defines a second groove configured to receive the bottom edge of the glare-blocking member.

20. The system of claim 17, wherein the rail further comprises:

a third projecting contour disposed between the first projecting contour and one of the left and right lateral portions; and a fourth projecting contour disposed between the second projecting contour and the other of the left and right lateral portions.

* * * * *